US006948618B2

(12) United States Patent
Luu et al.

(10) Patent No.: US 6,948,618 B2
(45) Date of Patent: Sep. 27, 2005

(54) PROTECTIVE PACKAGING SYSTEM

(76) Inventors: Tom Tho-Truong Luu, 232 Beegum Way, San Jose, CA (US) 95123; Ana Nicho Luu, 232 Beegum Way, San Jose, CA (US) 95123

( * ) Notice: Subject to any disclaimer, the term of this patent is extended or adjusted under 35 U.S.C. 154(b) by 115 days.

(21) Appl. No.: 10/428,189

(22) Filed: May 3, 2003

(65) Prior Publication Data

US 2003/0192806 A1 Oct. 16, 2003

Related U.S. Application Data

(63) Continuation-in-part of application No. 09/969,696, filed on Oct. 3, 2001, now Pat. No. 6,676,011.

(51) Int. Cl.[7] ..... B65D 81/107

(52) U.S. Cl. ..... 206/594; 53/449; 53/472; 206/523; 206/591

(58) Field of Search ..... 53/399, 449, 467, 53/472; 206/523, 424, 460, 521, 521.2, 521.6, 522, 591, 592, 594; 229/117.33, 125.21, 125.38

(56) References Cited

U.S. PATENT DOCUMENTS 443,397 A * 12/1890 Mack ..... 229/115
2,956,672 A * 10/1960 Kirkpatrick ..... 206/497
3,211,283 A * 10/1965 Hassler ..... 206/424
3,752,301 A * 8/1973 Bluemel ..... 206/583
3,796,307 A * 3/1974 McKinney ..... 206/497
3,900,059 A * 8/1975 Kirk et al. ..... 383/11
3,938,728 A * 2/1976 Deards et al. ..... 229/117.23
RE29,721 E * 8/1978 Ukmar et al. ..... 222/105
4,133,430 A * 1/1979 Cravens ..... 206/497
4,190,158 A * 2/1980 Ambrose ..... 206/522
4,285,432 A * 8/1981 de Villers et al. ..... 206/591
4,560,090 A * 12/1985 Okushita ..... 222/81
4,757,900 A * 7/1988 Misset et al. ..... 206/497
4,865,200 A * 9/1989 Sullivan et al. ..... 206/583
4,889,252 A * 12/1989 Rockom et al. ..... 229/103.11
5,086,925 A * 2/1992 Coalier et al. ..... 206/497
5,356,028 A * 10/1994 Heuberger et al. ..... 229/117.33
5,454,642 A * 10/1995 De Luca ..... 383/3
5,820,268 A * 10/1998 Becker et al. ..... 383/99
6,296,134 B1 * 10/2001 Cardinale ..... 220/62.21
6,308,828 B1 * 10/2001 Jones ..... 206/223
6,443,309 B1 * 9/2002 Becker ..... 206/594

* cited by examiner

*Primary Examiner*—Jim Foster
(74) *Attorney, Agent, or Firm*—Galbreath Law Offices, P.C.; John A. Galbreath

(57) ABSTRACT

A protective packaging system is disclosed, comprising a protective pouch open on one side. A closure tape is attached to the pouch's open side. The pouch also has an attachment block affixed to the outer surface. The attachment block has a layer of adhesive on its non-pouch-proximate face, and an cover panel covering the adhesive. A twist tie is also located on the bottom surface of pouch. The user pre-wraps a fragile object in the pouch, peels the cover panel from the attachment block, and then places the assembly into a box or other container where it adheres to the bottom of the container.

20 Claims, 4 Drawing Sheets

PROTECTIVE PACKAGING SYSTEM

CROSS-REFERENCES TO RELATED APPLICATIONS

This application is a continuation-in-part of U.S. patent application Ser. No. 09/969,696, filed on 3 Oct. 2001, U.S. Pat. No. 6,676,011.

BACKGROUND OF THE INVENTION

1. Field of the Invention

The invention relates generally to protective packaging systems, specifically a protective packaging system wherein a fragile object is conveniently pre-wrapped in a protective pouch, and then placed into a box or other container where it adheres to the bottom of the container.

2. Description of the Prior Art

There are other packaging boxes designed for packing items. Typical of these is U.S. Pat. No. 2,956,672 issued to Kirkpatrick on Oct. 18, 1960. Kirkpatrick's invention relates to packaging, and more particularly to a device for packing using a hammock pack that embodies a container such as a corrugated carton or box within and suspending the article, having ends fixed to opposite sides of the box.

Another patent was issued to Bluemel on Aug. 14, 1973 as U.S. Pat. No. 3,752,301. Bluemel's device is a shock-proof packing container for shipping fragile articles, comprising a rectangular outer carton, a polygonal inner support member that is adapted to fit snugly within the outer carton and bear against all four side walls of the outer carton, and a flexible sling attached to opposing walls of the inner support member and extending therebetween. Fragile articles are wrapped in this sling and are thereby suspended in the interior of the packing container. Locking flaps are attached to the inner support member so that the position of the inner support member with respect to the outer carton remains fixed.

Yet another U.S. Pat. No. 3,796,307 was issued to McKinney on Mar. 12, 1974. This invention comprises a corrugated package material wherein the corrugated fluting is attached to one or more sheets of heat shrinkable polymeric film. The heat shrinkable film is preferably on only one side of the corrugated fluting, but may be on both sides of the corrugated fluting. This packaging material is then formed into a carton and this carton filled; or is used to bundle a series of containers, and the final assembly, whether a carton or bundle, heat shrunk, whereby the strength of the corrugate is increased.

Still yet another was issued on Feb. 17, 1976 to Deards as U.S. Pat. No. 3,938,728. Deards' invention is a container assembly for biologically processing liquids, comprising an open-top box, a free-standing, block ended plastics-film sleeve fitted within the box, and a liquid-tight plastics-film liner, the depth of the box being not more that one-half that of the sleeve, and the sleeve preferably having a stiffening attachment or enclosure at its base, to fit the box.

Another patent was issued to Ukmar, et al. on Aug. 8, 1978 as U.S. Pat. No. Re. 29,721. Ukmar's invention is a package for bulk materials having a box-like protective container and plastic bag liner, and means for securing the bag in the container by a triangularly shaped flap formed by a fold of the bag wall, said means comprising a channel member and an elongated metal strip adapted to be secured in the groove of the channel member and secure the flap therebetween said bag also having triangularly shaped flaps for filing and emptying the bag.

Another patent was issued to Ambrose on Feb. 26, 1980 as U.S. Pat. No. 4,190,158. This invention is a container for delicate articles which includes an inner envelope, and an inflatable outer envelope sealed to the ends thereof The inner envelope is vented to the exterior of the container so that, on inflation of the outer envelope, the inner envelope is collapsed tightly about the article, which is thus suspended in and protected by the inflated outer envelope. Preferably, the inflation is accomplished within an outer protective casing, which is coated on its interior with an adhesive. Should the casing and outer envelope be punctured, the parts will then still be kept in essentially established positions.

Another patent was issued to de Villers et al. on Aug. 25, 1981 as U.S. Pat. No. 4,285,432. This invention relates to packaging for various fragile articles, including a method and particularly relates to the packaging of fragile articles such as glass lighting fixture globes including ones commonly known as "Tiffany" types.

Another patent was issued to Okushita on Dec. 24, 1985 as U.S. Pat. No. 4,560,090. This invention comprises the following: for the fabrication of a bag-in-box (BIB) package, there is first provided a semifinished, collapsed BIB package wherein a flattened bag is placed within a collapsed box and secured to at least one of its inside surfaces by means of an adhesive. After erecting the package, the bag is inflated into close internal contact with the box by introducing a gas under pressure through a fitment attached to the bag and projecting outwardly of the box. The opposite ends of the box are closed with sets of foldable end flaps, with the aid of an adhesive. Preferably, the bag is further secured to the inside surfaces of a pair of opposed ones of the four bottom end flaps of the box. The opposed pair of bottom flaps are held folded out during the introduction of the pressurized gas into the bag, in order that the bottom end portion of the inflated bag may make neat contact with the inside surfaces of the box. There is also disclosed herein an apparatus for thus fabricating the BIB package.

Another patent was issued to Misset et al. on Jul. 19, 1988 as U.S. Pat. No. 4,757,900. This invention relates to a packing case comprising a box, a heat-retractable plastic and at least one lid, for storing, handling and transporting a charge. In the said case, the heat-retractable plastic in sheet form is bonded at one or more of its edges to the outer surface of a wall of the said box, in the vicinity of the side of the said wall, and extends, on the outside, from the said edge to the side of the said wall and then inside the box, opposite the inner surface of the said wall, moving away from the latter towards the charge which is to be packed. In the said case, the charge is held down against the bottom by means of the heat-retractable plastic along an overlapping zone.

Another patent was issued to Coalier et al. on Feb. 11, 1992 as U.S. Pat. No. 5,086,925. This invention involved packaging made of card or similar material for packing a plurality of objects, the packaging comprising a body having a ring of sides and a bottom, thereby defining a volume for receiving said objects, and at least one sheet of shrinkable synthetic material fixed to said body for covering said plurality of objects and for holding the objects in place in said volume by said sheet being shrunk, said bottom being constituted by a plurality of flaps each of which is connected via a corresponding fold line to the bottom longitudinal edge of said ring of sides, said sheet being fixed to at least one of said bottom flaps which is covered, at least in part, by at least one other one of said bottom flaps is such a manner as to clamp said sheet between said flaps.

Another patent was issued to Heuberger et al. on Oct. 18, 1994 as U.S. Pat. No. 5,356,028. Heuberger's device is a preglued, flat folding box that contains a section of tubular film glued to the box to form an inner bag. The tubular film section has bending lines in all four comers of the body of the folding box which extend to the edges of the section of tubular film. This makes it easier to erect the folding box containing the section of tubular film and to fill and close the package.

Another patent was issued to Loeffler on Dec. 28, 1999 as U.S. Pat. No. 6,006,917. This invention comprises a packaging unit for articles to be packed in a sterile condition, in order to reduce the risk of damage and, at the same time, to decrease the material requirement. It is proposed that it comprise an inner bag sealed in a gas tight manner which surrounds the article to be packed and encloses the article in a tight manner due to evacuation, a closed outer bag which receives the inner bag, and a shape-retaining frame which holds the outer bag immovably and is insertable into a shape-retaining storage container.

SUMMARY OF THE INVENTION

The invention is a protective packaging system wherein a fragile object is conveniently pre-wrapped in a protective pouch, and then placed into a box or other container where it adheres to the bottom of the container. The invention is very useful in situations wherein the user desires to pre-wrap the fragile object and then place it in a shipping or storage container, rather than placing the fragile object in a pre-made box with a protective pouch attached inside, as shown in applicant's U.S. patent application Ser. No. 09/969,696. The present invention also allows a user to purchase only the interior pouch assembly, and supply his own box or container if desired.

Accordingly, it is a principal object of the invention to allow a user to conveniently pre-wrap a fragile object in a protective pouch, and then place the wrapped object into a box or other container where it adheres to the bottom of the container.

Another object of the present invention is to provide a user with the option of using his or her own box or other container.

Another object of the invention is to provide a means wherein a user can pack several items within one large box. The invention facilitates this objective, because the attachment block holds the objects securely to the box, while the protective pouch surrounds the object, thereby permitting several items to be packed within one large box.

Another object of the present invention is to provide a protective packaging system that protects the object within.

Another object of the present invention is to provide a protective packaging system that is easily assembled.

Yet another object of the present invention is to provide an all-in-one protective packaging system, wherein all necessary components are present for the user.

These and other objects of the present invention will become readily apparent upon further review of the following specification and drawings.

DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views and wherein.

DETAILED DESCRIPTION OF THE INVENTION

Figure 1:
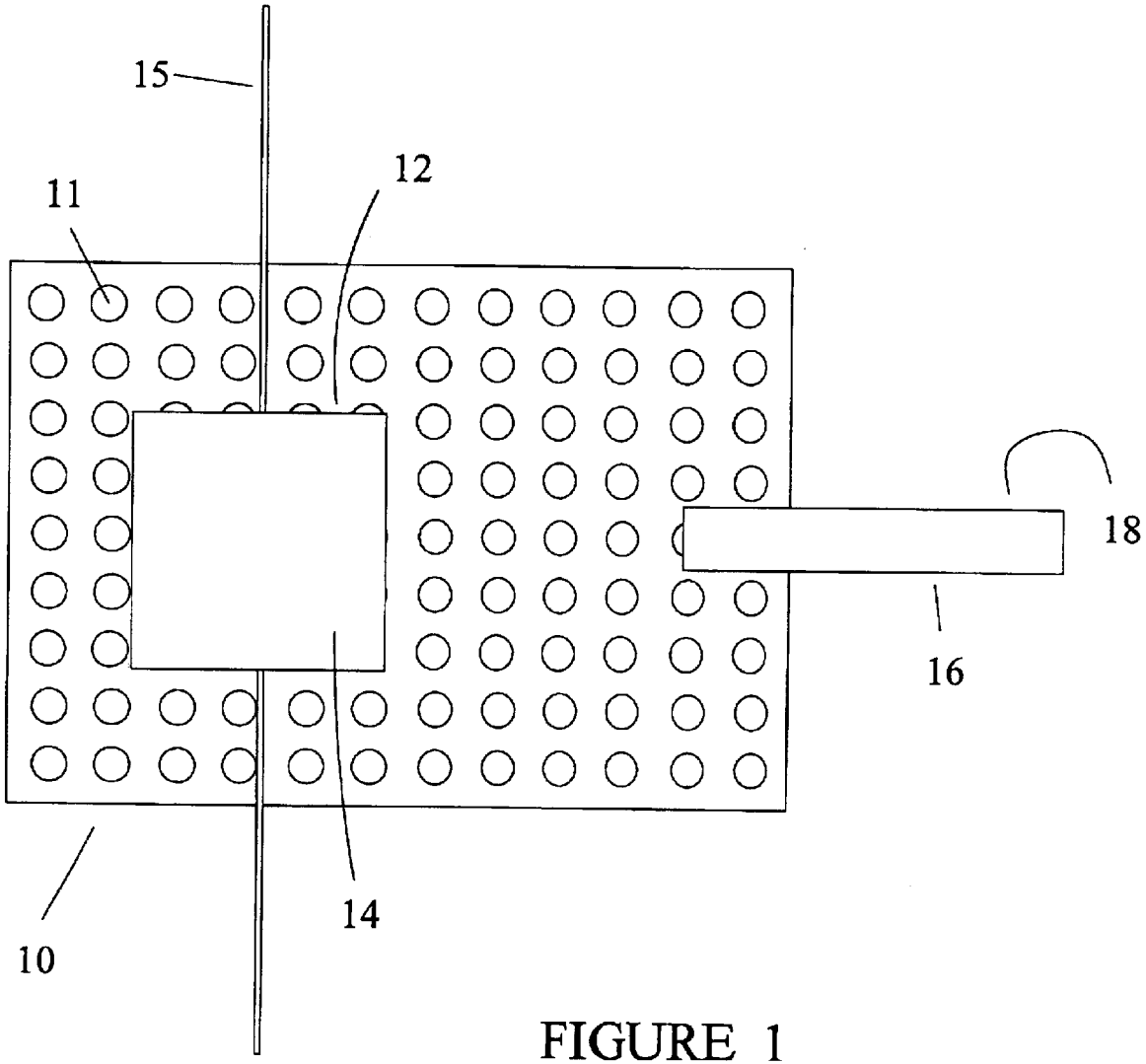
FIG. 1 is a bottom view of the invention, showing the pouch with attachment block, twist tie, and closure tape components.

The following provides a list of the reference characters used in the drawings:

| | |
|---|---|
| 10. | Pouch |
| 11. | Sealed air bubbles |
| 12. | Attachment block |
| 13. | Attachment block adhesive |
| 14. | Attachment block cover panel |
| 15. | Twist tie |
| 16. | Tape |
| 17. | Tape adhesive |
| 18. | Tape cover panel |
| 19. | Container |

As illustrated in FIG. 1, the main body of the invention comprises a pouch 10, open on one side. Sealed air bubbles 11 are disposed across the extent of pouch 10, i.e., pouch 10 is formed from the material commonly known as "bubble-wrap". A tape 16 is attached to the bottom surface of pouch 10,at pouch 10's open side. The bottom surface of tape 16 is non-adhesive, while the top surface of tape 16 is coated with a tape adhesive 17 and covered by a peelable tape cover panel 18.

Pouch 10 also has an attachment block 12 located on its bottom surface. Attachment block 12 is formed from a layer of sealed air bubble material, and is attached to pouch 10 using any suitable adhesive or non-adhesive method known in the art. Attachment block 12 also has a layer of attachment block adhesive 13 on its non-pouch-proximate face, and an attachment block cover panel 14 covering attachment block adhesive 13. A twist tie 15 is also located on the bottom surface of pouch 10. Twist tie 15 extends across attachment block 12 and past the edges of pouch 10, and is held in place by attachment block adhesive 13.

Figure 2:
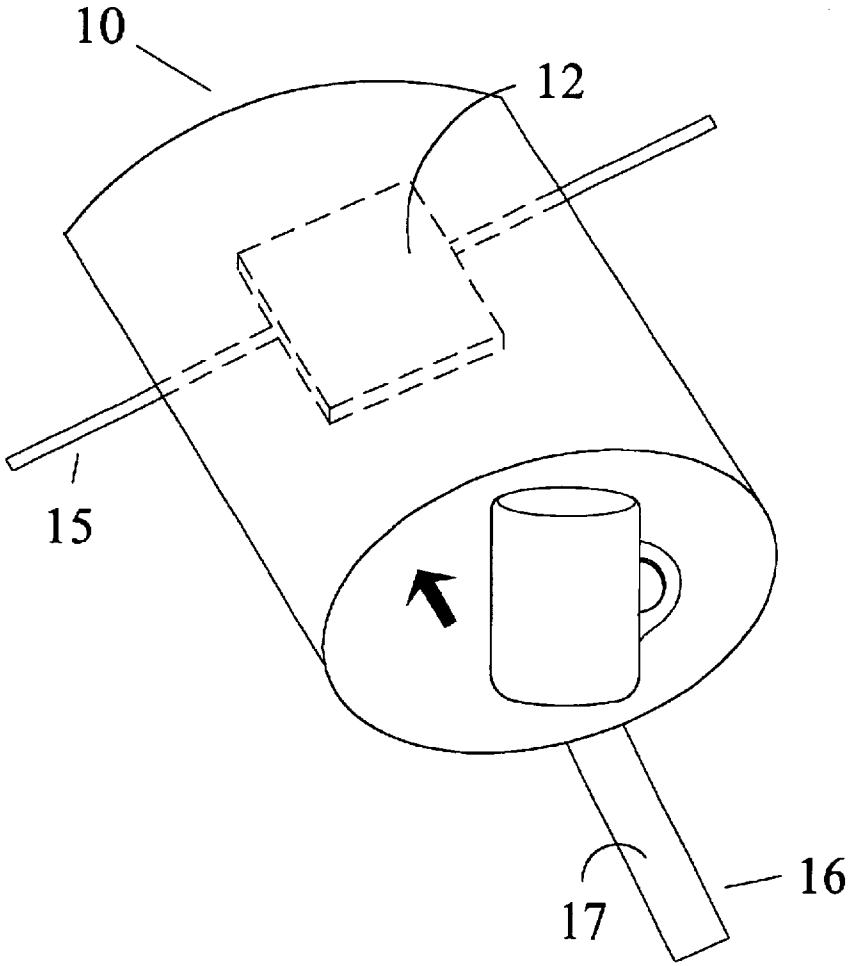
FIG. 2 is a perspective view, with the mouth of the pouch open and an object placed inside.

Turning now to the operation of the invention, FIG. 2 illustrates the invention with the mouth of pouch 10 open and an object placed inside. It can be appreciated that although the object is shown for the sake of clarity at the mouth of pouch 10, in practice the user would insert the object farther inside pouch 10, to approximately the area of attachment block 12. In FIG. 2, tape cover panel 18 has been removed, exposing tape adhesive 17. In FIG. 2, the sealed air bubbles 11 have been omitted for the sake of clarity; however, had sealed air bubbles 11 been shown, they would have extended across the surfaces of pouch 10.

Figure 3:
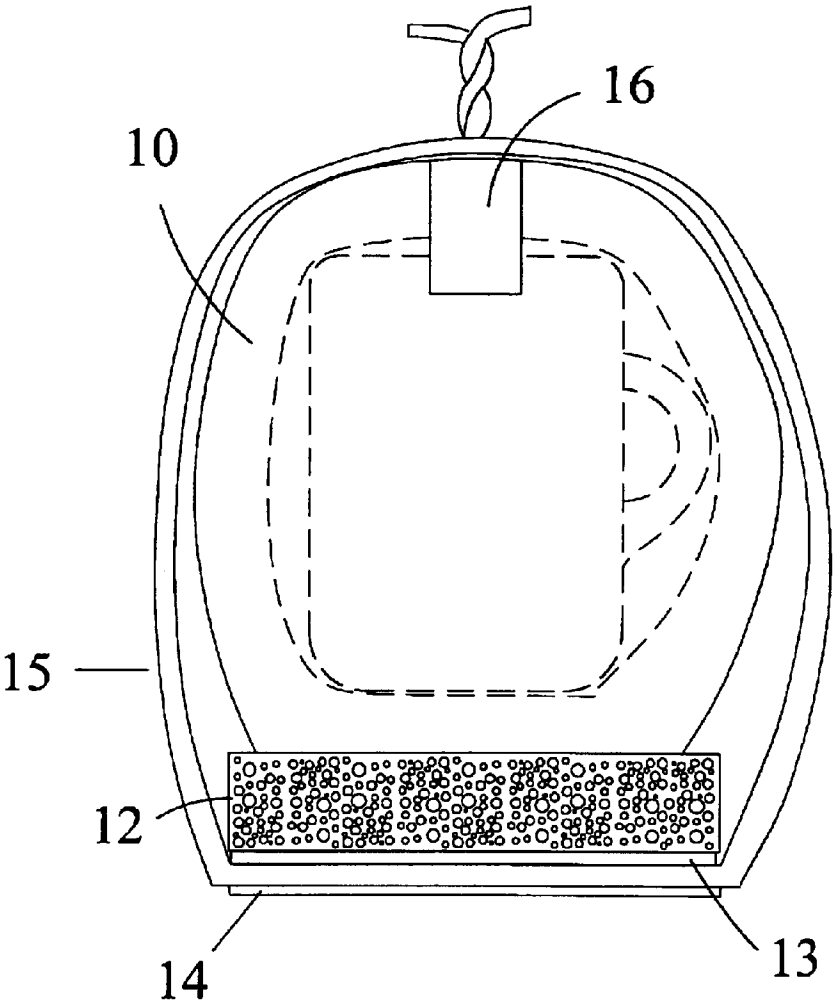
FIG. 3 is a front view showing the object inside the pouch, and the tape and twist ties in place.

As can be seen in FIG. 3, after positioning the object inside pouch 10, the user folds up and secures the unused portion of pouch 10 with tape 16. Additional securement is obtained using twist tie 15, which is wrapped around the object and pouch 10 and twisted together. In FIG. 3, the sealed air bubbles 11 have been omitted for the sake of clarity; however, had sealed air bubbles 11 been shown, they would have extended across the surface of pouch 10.

Figure 4:
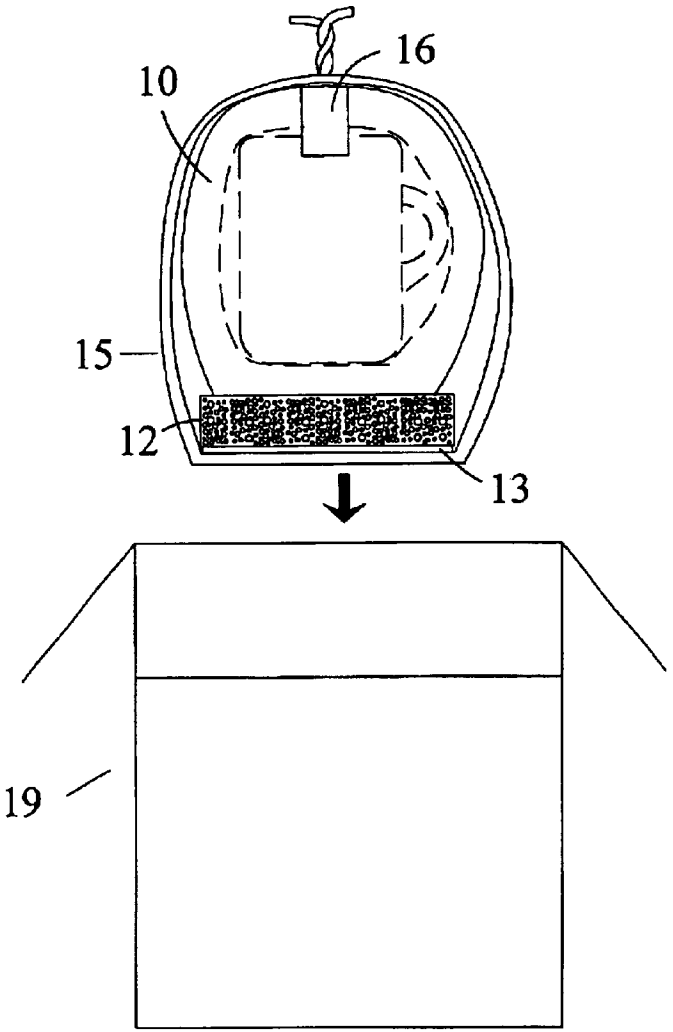
FIG. 4 is a front view showing the invention, with the object wrapped inside, being placed into a shipping or storage container.

FIG. 4 shows the invention, with the object wrapped inside pouch 10, being placed into a container 19 for shipping or storage. Before placing the object and pouch 10 into container 19,attachment block cover panel 14 is removed to expose attachment block adhesive 13. When the object and pouch 10 are inserted fully into container 19, attachment block adhesive 13 on attachment block 12 secures the object and pouch 10 to the inside bottom of container 19. The user seals container 19, and the object is then ready for shipment or storage.

Conclusions, Ramifications, and Scope:

While the above descriptions contain many specificities, these shall not be construed as limitations on the scope of the invention, but rather as exemplifications of embodiments thereof. Many other variations are possible. Examples of just a few of the possible variations follow:

The box or other container can be supplied with the pouch and its associated components, or alternatively, the pouch and its associated components can be supplied alone, with the user providing his or her own box or other container.

The size and type of the container used can be different than the box shown in the drawings. If a large box is used, the user can pack several items within that large box, instead of packing just one item in the box. The invention facilitates this, because the attachment block holds the objects securely to the box, while the protective pouch surrounds the object, thereby permitting several items to be packed within one large box.

The shape and size of the protective pouch can be different than that shown. The pouch can be constructed of alternative cushioning material, besides the bubble-wrap material shown. In addition, the protective body can be in a different form than the pouch shown in FIGS. 1–4. As just one example, it can also be in the simpler form of a sheet of bubble wrap or similar protective material which is wrapped around the object, gathered up, and held in place by the tape, twist tie, or other suitable method.

The attachment block shape and thickness can be different than that shown. In addition, the attachment block can be formed from a material different than the sealed air bubble material shown and described. As just a few examples, expanded or extruded polystyrene, or open or closed cell foam, or any other suitable cushioning material can be used. The attachment block adhesive can be of the wettable type, instead of the self-adhesive type, activated by peeling off a cover panel, shown in the figures. Alternatively, the attachment block can be eliminated, and adhesive instead placed directly on the outside of the pouch or protective sheet and covered by a cover panel.

The twist tie can be of two pieces, and can be located differently than is shown. The length or width of the twist tie can be different than that shown.

The length, width, and location of the tape can be different. All that is required is that the tape be suitably sized to hold the pouch or the gathered-up protective sheet material together after the fragile object has been wrapped. The tape can employ wettable adhesive, instead of the self-adhesive type, activated by peeling off a cover panel, shown in the figures.

The tie member that additionally secures the gathered-up pouch or sheet-form protective material can be different than the twist-tie shown. As just a few examples, it can be constructed of twine, rope, cable, or similar item.

In addition, either the twist tie or the tape can be eliminated. Both can be eliminated if the completed pouch, with the object inside, is a tight enough fit with the box, such that the pouch remains in place covering the object during shipment.

Accordingly, the scope of the invention should be determined not by the embodiments illustrated, but by the appended claims and their legal equivalents.

What is claimed is:

1. A packaging system for protecting an object, comprising:

a) a container, b) a protective body, and an object located within said protective body, c) user-activated attachment means adhesively attaching said protective body to an interior surface of said container, and d) wherein said user-activated attachment means comprise an attachment block affixed to said protective body and adhesive located on a non-protective-body-proximate surface of said attachment block, for attaching said protective body to said interior surface of said container, said object within said protective body sitting on said attachment block;

whereby said object is protected from damage during shipment or storage.

2. The packaging system of claim 1, wherein said protective body comprises a pouch open on a side thereof.

3. The packaging system of claim 2, wherein said pouch has a plurality of sealed air bubbles located on a surface thereof.

4. The packaging system of claim 1, wherein said attachment block is substantially square-shaped.

5. The packaging system of claim 1, wherein said packaging system also comprises a closure tape affixed to said protective body, said tape having adhesive located on a surface thereof.

6. The packaging system of claim 1, wherein said packaging system also comprises a tie member.

7. The packaging system of claim 6, wherein said tie member extends transversely across the width of said protective body.

8. A method for protectively packaging an object, comprising:

a) providing a container, b) providing a protective body and an object located within said protective body, c) providing user-activated attachment means for attaching said protective body to an interior surface of said container, wherein said user-activated attachment means comprise an attachment block affixed to said protective body and adhesive located on a non-protective-body-proximate surface of said attachment block, for attaching said protective body to said interior surface of said container, said object within said protective body sitting on said attachment block, d) surrounding said object with said protective body, e) inserting said protective body and object into said container, and f) attaching said protective body to said interior surface of said container using said user-activated attachment means, whereby said object is protected from damage during shipment or storage.

9. The method of claim 8, wherein an attachment block cover panel is removably affixed to said attachment block, covering said adhesive before step e.

10. The method of claim 9, wherein said attachment block cover panel is removed from said attachment block before step e.

11. The method of claim 8, wherein said protective body comprises a pouch open on a side thereof.

12. The method of claim 11, wherein said pouch has a plurality of sealed air bubbles located on a surface thereof.

13. The method of claim 8, wherein said attachment block is substantially square-shaped.

14. The method of claim 13, wherein an attachment block cover panel is removably affixed to said attachment block, covering said adhesive.

15. The method of claim 8, wherein said packaging system also comprises a closure tape affixed to said protective body, said tape having adhesive located on a surface thereof.

16. The method of claim 15, wherein a tape cover panel is removably affixed to said tape, covering said adhesive.

17. The method of claim 16, wherein said packaging system also comprises a tie member.

18. The method of claim 17, wherein said tie member extends transversely across the width of said protective body.

19. A protective package, comprising:

a) a pouch open at one end, b) a tape attached proximate said opening and extending from said opening for closing said opening, c) a block attached to a bottom of the bag, d) a twist tie attached to the block on a bottom side of the block opposite to the attachment of the block with the pouch, e) a cover covering said block and an intermediate portion of said twist tie, f) wherein the extent of said twist tie is transverse to the extent of said tape.

20. The packaging system of claim 19, wherein a tape cover panel is removably affixed to said tape, covering said adhesive.

* * * * *